United States Patent [19]

Rutherford

[11] Patent Number: 4,732,511

[45] Date of Patent: Mar. 22, 1988

[54] MINE ROOF SUPPORTS

[75] Inventor: Dennis F. Rutherford, Cheltenham, England

[73] Assignee: Dowty Mining Equipment Ltd., Tewkesbury, England

[21] Appl. No.: 495,454

[22] Filed: May 19, 1983

Related U.S. Application Data

[63] Continuation of Ser. No. 290,221, Aug. 5, 1981, abandoned.

[30] Foreign Application Priority Data

Aug. 16, 1980 [GB] United Kingdom ..... 8026754

[51] Int. Cl.[4] ..... E21D 23/04

[52] U.S. Cl. ..... 405/296; 405/291

[58] Field of Search ..... 405/291–296; 299/31, 33

[56] References Cited

U.S. PATENT DOCUMENTS 4,048,804 9/1977 Elsner et al. ..... 405/296 X 4,231,684 11/1980 Oppenländer et al. ..... 405/295 X

FOREIGN PATENT DOCUMENTS 2321233 11/1973 Fed. Rep. of Germany ..... 405/295

1526399 9/1978 United Kingdom ..... 405/296

*Primary Examiner*—David H. Corbin

*Attorney, Agent, or Firm*—Hayes, Davis & Soloway

[57] ABSTRACT

A mine roof support includes a pair of substantially-parallel floor-engaging members, a roof engageable member, a shield pivotally-connected to the floor-engaging members, by at least one pair of parallel links, and pivotally-connected to the roof-engageable member, and prop means carried by the floor-engaging members by which the roof-engageable member can be urged into engagement with a mine roof. A strengthening member connects the pair of parallel links. The strengthening member and the pair of parallel links provide the sole connection between the rear-end portions of the floor-engaging members by which the forces tending to cause relative displacement of those rear-end portions in the vertical direction are substantially resisted.

4 Claims, 3 Drawing Figures

MINE ROOF SUPPORTS

Figure 1:
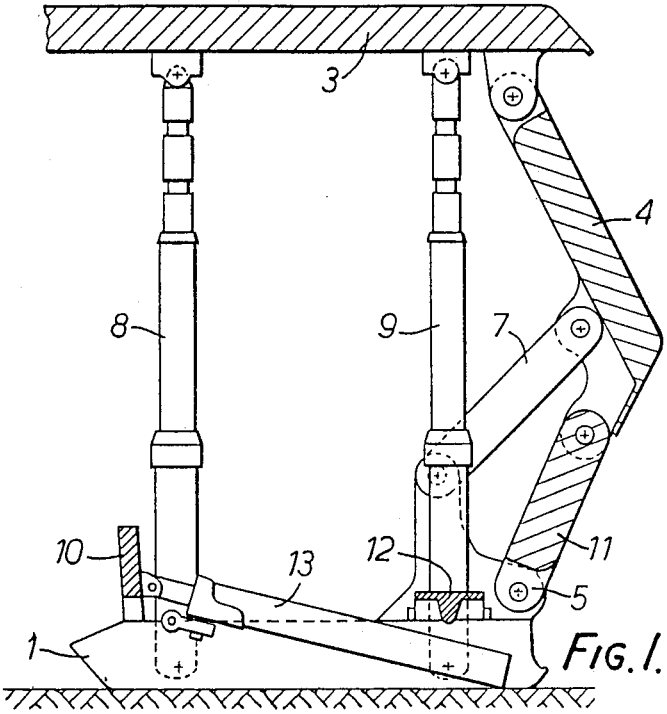

This is a continuation of application Ser. No. 290,221, filed Aug. 5, 1981, now abandoned.

This invention relates to mine roof supports, in particular those which are commonly referred to as shield supports and as chock-shield supports.

Such a support comprises a pair of substantially-parallel floor-engaging members spaced apart the one from the other, a roof-engageable member or members, and a shield which is pivotally-mounted with respect to the roof-engageable member or members and which is also pivotally-mounted with respect to, and supported on, the pair of floor-engaging members.

In some constructions, the shield is supported on the pair of floor-engaging members by way of a pair of links, one of which is pivotally-mounted on the one floor-engaging member and the other of which is pivotally-mounted on the other floor-engaging member, the two links being substantially-parallel the one to the other.

In other constructions, the shield is additionally supported on the pair of floor-engaging members by way of a further pair of links, one of which is pivotally-mounted on one floor-engaging member and the other of which is pivotally-mounted on the other floor-engaging member, the two links being substantially-parallel the one to the other.

The roof-engageable member or members can be urged into engagement with a roof by means of prop means carried by the floor-engaging members. In some constructions, the prop means is connected between the floor-engaging members and the shield. In other constructions, the prop means is connected between the floor-engaging members and the roof-engageable member or members. In yet further constructions, a prop means is connected between the floor-engaging member or members and the shield, and a further prop means is also connected between the floor-engaging members and the roof-engageable member or members.

In some constructions the shield is a single member while in other constructions it is formed from at least two members.

It is advantageous in some mining conditions for the floor-engaging members of such a roof support to be part of a base structure which is substantially-stiff in the vertical direction. To that end, it has been the practice directly to connect the floor-engaging members at or near to one end by a bridge member and at or near to the other end by a second bridge member. Each bridge member imparts the required stiffness to the base structure by being capable of resisting those forces which tend to cause relative displacement, in the vertical direction, of the end portions of the floor-engaging members which are connected together by the bridge member.

When used in a mine, those end portions of the pair of floor-engaging members which support the shields are further away from a coal face being cut than are the other end portions. As the coal face is being cut away, a mine roof support is moved towards the newly-cut face. As a consequence, it is necessary for the bridge members at the "shield-end portion" of the floor-engaging members (hereinafter referred to as the "rear bridge member") to be suitably shaped so that any loose material which has fallen between the pair of floor-engaging members when a roof has been supported by a support will not be carried forward by the bridge member when the support is advanced towards a newly-cut face.

Such a rear bridge member is of substantial proportions and takes up space, which is at a premium below the roof-engageable member or members of a mine roof support, is costly, and does not always afford the desired feature of passing over that loose material which may be between the pair of floor-engaging members, when a support is moved towards a newly-cut face. Further, placing the rear bridge member in a position where it does not interfere with the prop means at that end portion of the support may require the floor-engaging members to be longer than they otherwise would be.

It is an object of this invention to provide an improved mine roof support.

According to this invention there is provided a mine roof support having a pair of substantially-parallel floor-engaging members, a roof-engageable member or members, a sheld pivotally-connected to the floor-engaging members, by at least one pair of parallel links, and pivotally-connected to the roof-engageable member or members, prop means carried by the floor-engaging members by which the roof-engageable member or members can be urged into engagement with a roof, and a strengthening member connecting a pair of parallel links, the strengthening member and the pair of parallel links providing the sole connection between the rear-end portions of the floor-engaging members by which the forces tending to cause relative displacement of those rear-end portions in the vertical direction are substantially resisted.

The rear-end portions of the floor-engaging members may be further connected by a member which provides little or no resistance to the said forces.

The pair of parallel links and the strengthening member may, conveniently, provide a torsion box.

The pair of parallel links and the strengthening member may be integral.

When the mine roof support has two pairs of parallel links, one pair of which will be above the other pair, the strengthening member may be connected either to the pair of links which are lowermost or to the pair of links which are uppermost.

The said member by which said rear-end portions are further connected and which provides little or no resistance to the said forces is such that its proportions are considerably less than those of the customary rear bridge member. The said member may be flexible or may be pivotally-connected to the floor-engaging members and the greater part of it at least will be above the floor-engaging members. Such a member can provide a buffer to control lifting of the rear end of the ram which is employed to advance a mine roof support towards a newly-cut coal face or, in another ram arrangement, may provide an attachment point for the ram. Further, such a member may resist, wholly or partly, the forces tending to displace the floor-engaging members relatively in a horizontal direction parallel to the direction of intended movement of the roof support when in a mine.

A mine roof support in accordance with one embodiment of the invention, in which the prop means is connected between the floor-engaging members and a roof-engageable member and which is shown merely to exemplify the invention, is illustrated in the accompanying drawings of which:

FIG. 1 is a side view of the mine roof support, partly in section, and

Figure 2A:
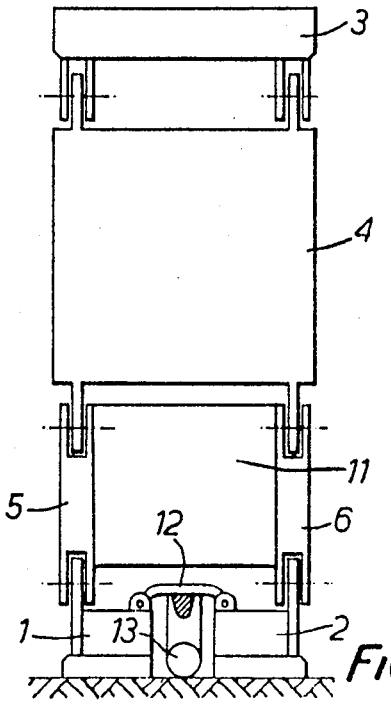
Figure 2B:
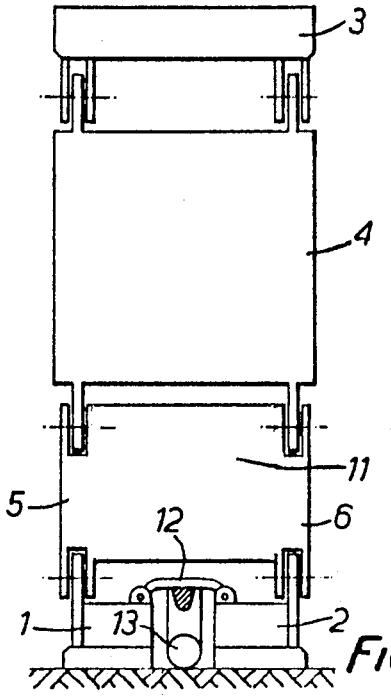

FIGS. 2*a* and 2*b* are rear views of two embodiments of the mine roof support.

Referring to the drawings the mine roof support comprises a pair of substantially-parallel floor-engaging members 1,2, spaced apart the one from the other and a roof-engageable member 3. A shield 4 is pivotally-mounted with respect to the roof-engageable member 3 and is also pivotally-mounted with respect to, and supported on, the pair of floor-engaging members 1, 2.

The shield 4 is supported on the pair of floor-engaging members 1, 2, by way of a pair of links 5, 6, one of which, 5, is pivotally-mounted on the floor-engaging member 1 and the other of which, 6, is pivotally-mounted on the floor-engaging member 2. The two links are substantially-parallel the one to the other.

The shield 4 is additionally supported on the pair of floor-engaging members 1, 2, by way of a further pair of links, one of which, 7, is pivotally-mounted on the floor-engaging member 1 and the other of which, not visible in the drawings, is pivotally-mounted on the floor-engaging member 2. The links of this further pair are substantially-parallel the one to the other.

The roof-engageable member can be urged into engagement with the roof of a mine by two pairs of props carried by the floor-engaging members. The prop 8 of one pair of shown in FIG. 1, as is the prop 9 of the other pair, the props 8 and 9 being carried by the floor-engaging member 1 and the other props being carried by the floor-engaging member 2.

The end portions of the floor-engaging members 1, 2, which are remote from the shield 4 are connected by a bridge member 10. At the other end portions of the floor-engaging members 1, 2, there is no rear bridge member connecting the one floor-engaging member to the other floor-engaging member as has been customary. Instead the pair of links 5, 6, are connected by a strengthening member 11, FIG. 2*a* which three parts, in other embodiments may together comprise an integral construction FIG. 2*b*. The pair of links and the strengthening member are torsionally stiff and thus provide a torsion box affording substantial resistance to the forces tending to cause relative displacement in the vertical direction of the rear-end portions of the floor-engaging members.

The rear-end portions of the floor-engaging members 1, 2 may be also connected by a member 12, whose proportions are considerably less than those of the customary rear bridge member, one end of which may be pivotally-connected to the floor-engaging member 1 and the other end of which may be pivotally-connected to the floor-engaging member 2. This member can act as a buffer to control lifting of the rear end of the mine-roof-support-advancing ram 13 and can offer resistance to any forces tending to displace the floor-engaging members relatively in a horizontal direction parallel to the direction of intended movement of the mine roof support when the ram 13 is suitable energised. However the member 12 can offer little or no resistance to the forces tending to cause relative displacement of the rear-end portions of the members 1 and 2 in the vertical direction.

I claim:

1. A mine roof support having a pair of separate substantially parallel spaced apart floor-engaging members, a roof-engageable member or members, a shield pivotally-connected to the roof-engageable member or members, prop means carried by the floor engaging members by which the roof-engageable member or members can be urged into engagement with a roof and a strengthening member interconnecting a pair of parallel links to form therewith a torsionally-stiff device providing the sole direct connection between the rear-end portions of the floor-engaging members by which the forces tending to cause relative displacement of those rear-end portions in the vertical direction are substantially resisted and being constructed to provide a torsion box with the parallel links, which torsion box is sufficiently rigid to resist anticipated forces tending to cause such relative displacement.

2. A mine roof support as claimed in claim 1 in which the pair of parallel links and the strengthening member provide a torsion box.

3. A mine roof support as claimed in claim 1 in which the pair of parallel links and the strengthening member are integral.

4. A mine roof support according to claim 1, wherein said pair of parallel links interconnected by the strengthening member are pivotally connected one to each of the floor engaging members.

* * * * *